US005864081A

United States Patent [19]

Iwase et al.

[11] Patent Number: 5,864,081

[45] Date of Patent: Jan. 26, 1999

[54] MUSICAL TONE GENERATING APPARATUS, MUSICAL TONE GENERATING METHOD AND STORAGE MEDIUM

[75] Inventors: Hiroyuki Iwase; Tomoyuki Kumagai, both of Hamamatsu, Japan

[73] Assignee: Yamaha Corporation, Hamamatsu, Japan

[21] Appl. No.: 13,879

[22] Filed: Jan. 27, 1998

[30] Foreign Application Priority Data

Jan. 29, 1997 [JP] Japan ..... 9-028324

[51] Int. Cl.[6] ..... G10H 1/06

[52] U.S. Cl. ..... 84/622; 84/645

[58] Field of Search ..... 84/622–625, 645

[56] References Cited

U.S. PATENT DOCUMENTS

| | | | |
|---|---|---|---|
| 4,791,847 | 12/1988 | Nishimoto | 84/622 |
| 4,829,869 | 5/1989 | Katada et al. | 84/622 |
| 5,125,315 | 6/1992 | Kawashima | 84/622 X |
| 5,340,940 | 8/1994 | Iizuka et al. | 84/622 |
| 5,420,374 | 5/1995 | Hotta | 84/622 |

*Primary Examiner*—Stanley J. Witkowski

*Attorney, Agent, or Firm*—Graham & James LLP

[57] ABSTRACT

A musical tone generating apparatus is provided that generates a musical tone of a selected one of tone colors that is defined by a combination of a first kind of number and a second kind of number. An operating element used for setting a tone color and having an incrementing function and a decrementing function is operated to set at least the second kind of number by using at least one of the incrementing function and decrementing function. A memory device stores a list in which the tone colors to be selected are listed, the list having a first axis having a plurality of locations to which a plurality of first kind of numbers are respectively assigned, and a second axis having a plurality of locations to which a plurality of second kind of numbers are respectively assigned, each of the first kind of numbers having a basic tone color assigned thereto, each of the second kind of numbers having an extended tone color that is a variation of the basic tone color of a corresponding one of the first kind of numbers. Each time the operating element is operated, one of the second kind of numbers that is assigned to a currently selected tone color is changed to a number of the second kind assigned to a tone color that is different from the currently selected tone color and is present next to the currently selected tone color in the list.

12 Claims, 5 Drawing Sheets

FIG.4

| Groupe | Pgm | Bank0 | Bank1 | Bank3 | Bank6 | Bank8 | Bank12 | Bank14 | Bank16 | Bank17 | Bank18 | Bank19 |
|---|---|---|---|---|---|---|---|---|---|---|---|---|
| Piano | 1 | GrandPno | GrandPnok | | | | | | | | MelloGrp | |
| | 2 | BritePno | BritePnok | | | | | | | | | |
| | 3 | E.Grand | ElgrPnok | | | | | | | | | |
| | 4 | HnkyTonk | HnkyTonkK | | | | | | | | | |
| | 5 | E.Piano1 | E.Piano1K | | | | | | | | MelloEP1 | |
| | 6 | E.Piano2 | E.Piano2K | | | | | | | | | |
| | 7 | Harpsi. | Harpsi.K | | | | | | | | | |
| | 8 | Clavi. | Clavi.K | | | | | | | | | |
| ⋮ | ⋮ | ⋮ | ⋮ | ⋮ | ⋮ | ⋮ | ⋮ | ⋮ | ⋮ | ⋮ | ⋮ | ⋮ |
| Bass | 33 | Aco.Bass | | | | | | | | | | |
| | 34 | FngrBass | | | | | | | | | FingrDrk | |
| | 35 | PickBass | | | | | | | | | | |
| | 36 | Fretless | | | | | | | | | | |
| | 37 | SlapBas1 | | | | | | | | | | |
| | 38 | SlapBas2 | | | | | | | | | | |
| | 39 | SynBass1 | | | | | | | | | SynBa1DK | |
| | 40 | SynBass2 | | | MelloSB1 | | SeqBass | | | | ClkSynBa | SynBa2DK |
| ⋮ | ⋮ | ⋮ | ⋮ | ⋮ | ⋮ | ⋮ | ⋮ | ⋮ | ⋮ | ⋮ | ⋮ | ⋮ |

FIG.5

| Groupe | Pgm | Bank20 | Bank24 | Bank25 | Bank27 | Bank28 | Bank32 | Bank33 | Bank34 | Bank35 | Bank36 | Bank37 |
|---|---|---|---|---|---|---|---|---|---|---|---|---|
| Piano | 1 | | | | | | | | | | | |
| | 2 | | | | | | | | | | | |
| | 3 | | | | | | Det.CP80 | | | | | |
| | 4 | | | | | | | | | | | |
| | 5 | | | | | | Chor.EP1 | | | | | |
| | 6 | | | | | | Chor.EP2 | DXHard | DXLegend | | | |
| | 7 | | | Harpsi.2 | | | | | | Harpsi.3 | | |
| | 8 | | | | ClaviWah | | | | | | | |
| ⋮ | ⋮ | ⋮ | ⋮ | ⋮ | ⋮ | ⋮ | ⋮ | ⋮ | ⋮ | ⋮ | ⋮ | ⋮ |
| Bass | 33 | | | | | | | | | | | |
| | 34 | | | | FlangeBa | | | | | | | |
| | 35 | | | | | MutePkBa | | | | | | |
| | 36 | | | | | | Fretles2 | Fretles3 | Fretles4 | | | |
| | 37 | | | | ResoSlap | | PunchThm | | | | | |
| | 38 | | | | | | | | | | | |
| | 39 | FastResB | AciBass | | | | | | ClvBass | | | |
| | 40 | | | | | | SmthBa2 | | | | | |
| ⋮ | ⋮ | ⋮ | ⋮ | ⋮ | ⋮ | ⋮ | ⋮ | ⋮ | ⋮ | ⋮ | ⋮ | ⋮ |

FIG.6

| Groupe | Pgm | Bank38 | Bank39 | Bank40 | Bank41 | Bank42 | Bank43 | Bank45 | Bank64 | Bank65 | .... | Bank127 |
|---|---|---|---|---|---|---|---|---|---|---|---|---|
| Piano | 1 | | | PianoStr | Dream | | | | | | .... | |
| | 2 | | | | | | | | | | .... | |
| | 3 | | | ElgPno1 | ElGrPno2 | | | | | | .... | |
| | 4 | | | | | | | | | | .... | |
| | 5 | | | HardEl.P | | | | VXEl.P1 | 60sEl.P | | .... | |
| | 6 | | | DXPhase | DX+Analg | DXKotoEP | | VXEl.P2 | | | .... | |
| | 7 | | | | | | | | | | .... | |
| | 8 | | | | | | | | PulseClv | PierceCl | .... | |
| ⋮ | ⋮ | ⋮ | ⋮ | ⋮ | ⋮ | ⋮ | ⋮ | ⋮ | ⋮ | ⋮ | .... | ⋮ |
| Bass | 33 | | | JazzRthm | | | | VXUprght | | | .... | |
| | 34 | | | Ba&DstEG | | | FngrSlap | FngBass2 | JazzBass | ModAlem | .... | |
| | 35 | | | | | | | | | | .... | |
| | 36 | | | | | | | | | | .... | |
| | 37 | | | | | | | | | | .... | |
| | 38 | | | | | | VeloSlap | | | | .... | |
| | 39 | | | TeknoBa | | | | | Oscar | SqrBass | .... | |
| | 40 | | | ModulrBa | DX Bass | | | | X WireBa | | .... | |
| ⋮ | ⋮ | ⋮ | ⋮ | ⋮ | ⋮ | ⋮ | ⋮ | ⋮ | ⋮ | ⋮ | .... | ⋮ |

MUSICAL TONE GENERATING APPARATUS, MUSICAL TONE GENERATING METHOD AND STORAGE MEDIUM

BACKGROUND OF THE INVENTION

1. Field of the Invention

The present invention relates to a musical tone generating apparatus, a musical tone generating method and a storage medium, wherein a first kind of number and a second kind of number are used to select a tone color of musical tones to be generated, from a tone color table.

2. Prior Art

A sound source module is known as a musical tone generating apparatus adapted for generating musical tones in accordance with MIDI events entered through a keyboard, sequencer, or the like.

In an example of the sound source module, the tone color of a musical tone to be generated may be set by a bank number and a program change number, where the bank number is taken along the abscissa, and the program change number is taken along the ordinate, as shown in FIG. 3. For instance, the sound source module uses a tone color list or table that has 128 locations in rows to which bank numbers "0" through "127" are respectively assigned, and 128 locations in columns to which program change numbers "0" through "127" are respectively assigned. A particular tone color at the address (n, m) may be selected by setting the bank number to "n", and setting the program change number to "m".

One example of the above-described tone color list is shown in FIGS. 4, 5 and 6. It is to be noted that only two musical instrument groups of basic tones, namely, those of Piano and Bass, are shown in FIGS. 4–6, and other fourteen musical instrument groups are not shown herein. While this tone color list contains 128 banks as numbered from "0" to "127", banks following the bank number "65" are omitted in FIG. 6.

In this tone color list, eight program change numbers are assigned to each musical instrument group, and eight basic tone colors are stored in each musical instrument group. These basic tone colors are stored in the column of bank number "0", and the total number of basic tone colors stored in the bank number "0" is 128, namely 128 kinds of basic tone colors are stored in the tone color list.

Each bank having the bank number "1" to "127" may store an extended tone color that is a variation of a corresponding basic color stored in the bank number "0". The extended tone colors, however, are not necessarily stored in all of the banks having the bank numbers "1" through "127".

For example, extended tone colors of basic tone color "SynBass2" stored at the location of the program change number "40" and bank number "0" in the Bass group, for example, include an extended tone color "MelloSB1" stored at bank number "6", an extended tone color "Seq Bass" stored at bank number "12", an extended tone color "ClkSynBa" stored at bank number "18", an extended tone color "SynBa2DK" stored at bank number "19", and others. When the user selects a bank in which no extended tone color is named, musical tones having a corresponding basic tone color are generated.

When the sound source module having the above-described tone color list is used to generate musical tones, the user sets the bank number and program change number to appropriate values by means of a switch device, so that musical tones having a desired tone color are generated. This switch device consists of an increment switch and a decrement switch. In setting the bank number, the bank number is increased by 1 if the increment switch is operated by the user, and the bank number is decreased by 1 if the decrement switch is operated.

One example of setting of the bank number will be illustrated with respect to tone color "SynBass2" stored at the address of bank number "0" and program change number "40" (which will be referred to as "address (0, 40)"). If the increment switch is operated by the user while the tone color at the address (0, 40) is selected, this address is changed to address (1, 40) at which the basic tone color "Synbass2" is selected. If the increment switch is operated again, the current address is changed to address (2, 40) at which the basic tone color "Synbass2" is selected. If the increment switch is then serially operated, the current address is changed to address (3, 40) where the basic tone color "SynBass2" is selected, address (4, 40) where the basic tone color "SynBass2" is selected, address (5, 40) where the basic tone color "SynBass2" is selected, and then to the address (6, 40) where extended tone color "MelloSB1" is selected. Thus, the increment switch is operated six times so that the first extended tone color "MelloSB1" is selected. Since the second extended tone color "Seq Bass" is stored at address (12, 40) that is 6 banks ahead of the current address (6, 40), the same switch needs to be operated additional six times so as to select this extended tone color "Seq Bass".

Thus, the known sound source module has a problem that a desired tone color cannot be efficiently selected.

SUMMARY OF THE INVENTION

It is therefore an object of the invention to provide a musical tone generating apparatus, a musical tone generating method, and a storage medium, wherein a desired tone color can be selected with improved efficiency.

To attain the above object, according to a first aspect of the present invention, there is provided a musical tone generating apparatus that generates a musical tone of a selected one of tone colors that is defined by a combination of a first kind of number and a second kind of number, comprising an operating element used for setting a tone color and having an incrementing function and a decrementing function, the operating element being operated to set at least the second kind of number by using at least one of the incrementing function and decrementing function, and a memory device that stores a list in which the tone colors to be selected are listed, the list having a first axis having a plurality of locations to which a plurality of first kind of numbers are respectively assigned, and a second axis having a plurality of locations to which a plurality of second kind of numbers are respectively assigned, each of the first kind of numbers having a basic tone color assigned thereto, each of the second kind of numbers having an extended tone color that is a variation of the basic tone color of a corresponding one of the first kind of numbers, wherein each time the operating element is operated, one of the second kind of numbers that is assigned to a currently selected tone color is changed to a number of the second kind assigned to a tone color that is different from the currently selected tone color and is present next to the currently selected tone color in the list.

To attain the above object, according to a second aspect of the present invention, there is provided a musical tone generating apparatus that generates a musical tone of a selected one of tone colors that is defined by a combination of a first kind of number and a second kind of number, comprising an operating element used for setting a tone color and having an incrementing function and a decrementing function, the operating element being operated to set at least the second kind of number by using at least one of the incrementing function and the decrementing function, and a memory device that stores a list in which the tone colors to be selected are listed, the list having a first axis having a plurality of locations to which a plurality of first kind of numbers are respectively assigned, and a second axis having a plurality of locations to which a plurality of second kind of numbers are respectively assigned, each of the first kind of numbers having a basic tone color assigned thereto, each of the second kind of numbers having an extended tone color that is a variation of the basic tone color of a corresponding one of the first kind of numbers, and a switch device capable of switching between a first mode in which each time the operation part is operated, one of the second kind of numbers assigned to a currently selected tone color is changed to a number of the second kind that is different by one from the one of the second kind of numbers, and a second mode in which each time the operating element is operated, one of the second kind of numbers assigned to a currently selected tone color is changed to a number of the second kind assigned to a tone color that is different from the currently selected tone color and is present next to the currently selected tone color in the list.

Preferably, the musical tone generating apparatus according to the invention further comprises an input device through which a MIDI event is entered, and a musical tone signal producing device that produces a musical tone signal in accordance with the MIDI event entered through the input device, wherein the first kind of number is determined by a program change number of the MIDI event, and the second kind of number is determined by a bank number of the MIDI event.

In a typical form of the invention, the list contains basic tone colors that correspond one by one to all of the plurality of first kind of numbers, and expanded tone colors to which only a part of the plurality of second kind of numbers are assigned. When the second kind of number is set to a number of the second kind having no expanded tone color assigned thereto, a corresponding one of the basic tone colors is selected.

In a typical form of the invention, the basic tone colors comprise tone colors of normal musical instruments.

To attain the object, the present invention also provides a musical tone generating method for generating a musical tone of a selected one of tone colors that is defined by a combination of a first kind of number and a second kind of number, comprising the steps of setting at least the second kind of number by operating an operating element used for setting a tone color and having an incrementing function and a decrementing function, and storing in a memory device a list in which the tone colors to be selected are listed, the list having a first axis having a plurality of locations to which a plurality of first kind of numbers are respectively assigned, and a second axis having a plurality of locations to which a plurality of second kind of numbers are respectively assigned, each of the first kind of numbers having a basic tone color assigned thereto, each of the second kind of numbers having an extended tone color that is a variation of the basic tone color of a corresponding one of the first kind of numbers, wherein each time the operating element is operated, one of the second kind of numbers that is assigned to a currently selected tone color is changed to a number of the second kind assigned to a tone color that is different from the currently selected tone color and is present next to the currently selected tone color in the list.

To attain the object, the present invention also provides a musical tone generating method for generating a musical tone of a selected one of tone colors that is defined by a combination of a first kind of number and a second kind of number, comprising the steps of setting at least the second kind of number by operating an operating element used for setting a tone color and having an incrementing function and a decrementing function, and storing in a memory device a list in which the tone colors to be selected are listed, the list having a first axis having a plurality of locations to which a plurality of first kind of numbers are respectively assigned, and a second axis having a plurality of locations to which a plurality of second type of numbers are respectively assigned, each of the first kind of numbers having a basic tone color assigned thereto, each of the second kind of numbers having an extended tone color that is a variation of the basic tone color of a corresponding one of the first kind of numbers, and switching a mode for setting the second kind of number between a first mode in which each time the operation part is operated, one of the second kind of numbers assigned to a currently selected tone color is changed to a number of the second kind that is different by one from the one of the second kind of numbers, and a second mode in which each time the operating element is operated, one of the second kind of numbers assigned to a currently selected tone color is changed to a number of the second kind assigned to a tone color that is different from the currently selected tone color and is present next to the currently selected tone color in the list.

To attain the object, the present invention further provides a storage medium storing commands that are readable by a machine, to execute a musical tone generating method for generating a musical tone of a selected one of tone colors that is defined by a combination of a first kind of number and a second kind of number, the musical tone generating method comprising the steps of setting at least the second kind of number by operating an operating element used for setting a tone color and having an incrementing function and a decrementing function, and storing in a memory device a list in which the tone colors to be selected are listed, the list having a first axis having a plurality of locations to which a plurality of first kind of numbers are respectively assigned, and a second axis having a plurality of locations to which a plurality of second kind of numbers are respectively assigned, each of the first kind of numbers having a basic tone color assigned thereto, each of the second kind of numbers having an extended tone color that is a variation of the basic tone color of a corresponding one of the first kind of numbers, wherein each time the operating element is operated, one of the second kind of numbers that is assigned to a currently selected tone color is changed to a number of the second kind assigned to a tone color that is different from the currently selected tone color and is present next to the currently selected tone color in the list.

To attain the object, the present invention also provides a storage medium storing commands that are readable by a machine, to execute a musical tone generating method for generating a musical tone of a selected one of tone colors that is defined by a combination of a first kind of number and a second kind of number, the musical tone generating method comprising the steps of setting at least the second kind of number by operating an operating element used for setting a tone color and having an incrementing function and a decrementing function, and storing in a memory device a list in which the tone colors to be selected are listed, the list having a first axis having a plurality of locations to which a plurality of first kind of numbers are respectively assigned, and a second axis having a plurality of locations to which a plurality of second kind of numbers are respectively assigned, each of the first kind of numbers having a basic tone color assigned thereto, each of the second kind of numbers having an extended tone color that is a variation of the basic tone color of a corresponding one of the first kind of numbers, and switching a mode for setting the second kind of number between a first mode in which each time the operation part is operated, one of the second kind of numbers assigned to a currently selected tone color is changed to a number of the second kind that is different by one from the one of the second kind of numbers, and a second mode in which each time the operating element is operated, one of the second kind of numbers assigned to a currently selected tone color is changed to a number of the second kind assigned to a tone color that is different from the currently selected tone color and is present next to the currently selected tone color in the list.

According to the present invention, a bank number as the second kind of number may be set to the next or previous bank number assigned to a location in which a tone color different from the currently selected tone color is present, each time the operating element used for setting the tone color and having the incrementing and decrementing functions is operated. Thus, the operation for selecting the tone color can be simplified, and setting of the tone color may be accomplished with improved efficiency.

In one form of the present invention, the user may be allowed to select one of two modes, namely, a first mode in which the bank number is set in the manner as described above, and a second mode in which the bank number is set in a known method.

The above and other objects, features, and advantages of the invention will become more apparent from the following detailed description taken in conjunction with the accompanying drawings.

BRIEF DESCRIPTION OF THE DRAWINGS

FIG. 4 is a view showing a part of one example of tone color list;

FIG. 5 is a view showing a part of the tone color list following that of FIG. 4; and FIG. 6 is a view showing a part of the tone color list following that of FIG. 5.

DETAILED DESCRIPTION

The invention will now be described in detail with reference to the drawings showing an embodiment thereof.

Figure 1:
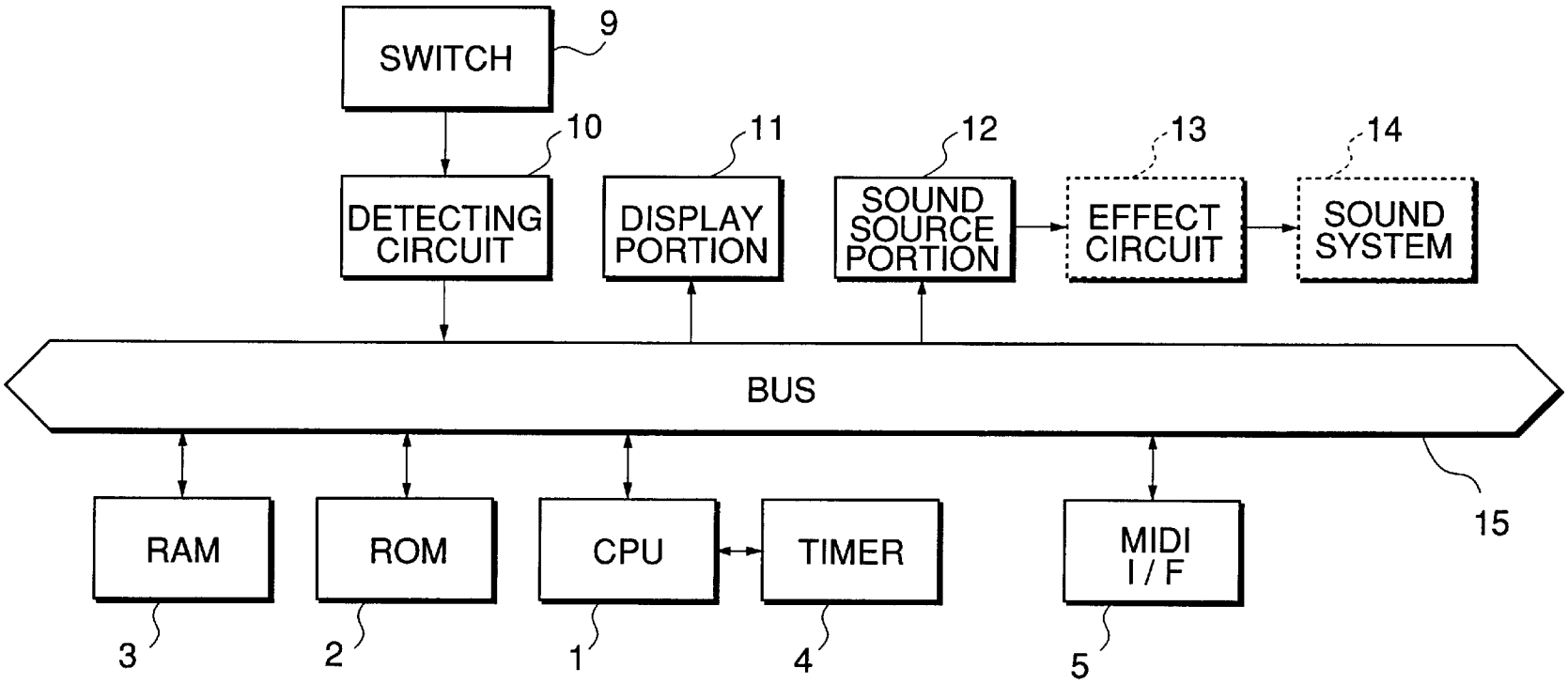
FIG. 1 is a block diagram showing the construction of a sound source module as a musical tone generating apparatus according to one embodiment of the present invention.

FIG. 1 shows the construction of a sound source module as one embodiment of the musical tone generating apparatus of the invention.

In FIG. 1, the sound source module of the present embodiment includes a central processing unit (CPU) 1 that executes control programs to perform control and other operations relating to musical tone generation, a read-only memory (ROM) 2 that stores control programs executed by the CPU 1, a tone color list, musical tone parameters of each tone color on the tone color list, and others, a random-access memory (RAM) 3 in which a work memory area of CPU 1, a voice buffer area, and others are established, a timer 4 that provides timing to CPU 1 when executing a timer interrupt routine(s), and a MIDI interface (MIDI I/F) 5 that receives MIDI data from a MIDI keyboard, a sequencer, or the like, and outputs MIDI data produced.

The sound source module of the present embodiment further includes a switch device 9 provided on a panel, a detecting circuit 10, a display block 11, a tone generator block 12, an effect circuit 13, a sound system 14, and a bus 15. The switch device 9 mainly consists of an increment switch, a decrement switch, a mode change switch and others, and is connected to the bus 15 through the detecting circuit 10. The display block 11 is comprised of a display, such as LCD, on which the name of a currently selected tone color, its bank number and a program change number, and other information if desired are displayed. The tone generator block 12 produces a musical tone signal based on MIDI data entered through the MIDI I/F 5, and the effect circuit 13 gives an effect of reverb, chorus, or the like, to a musical sound signal received from the tone generator block 12. The sound system 14 amplifies the musical tone signal that has been given a desired effect and generated by the effect circuit 13, and releases the amplified musical tone. The effect circuit 13 and sound system 14 may be provided as external devices.

Figure 2A:
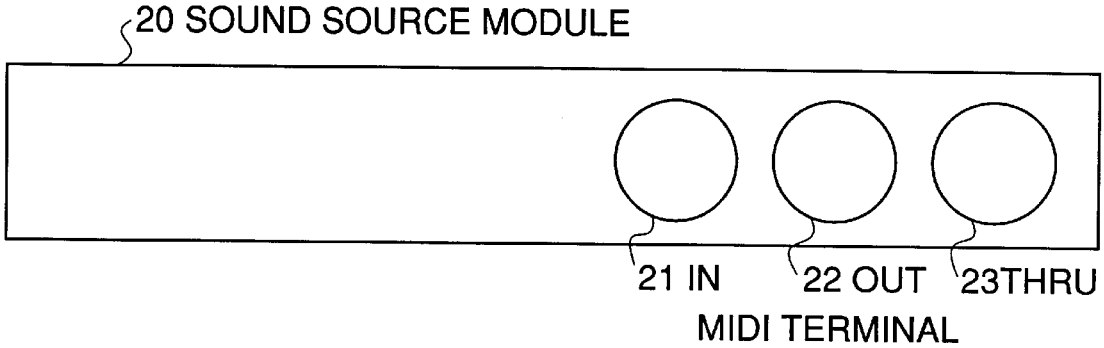
FIG. 2A is a view showing the construction of a back panel of the sound source module of FIG. 1.
Figure 2B:
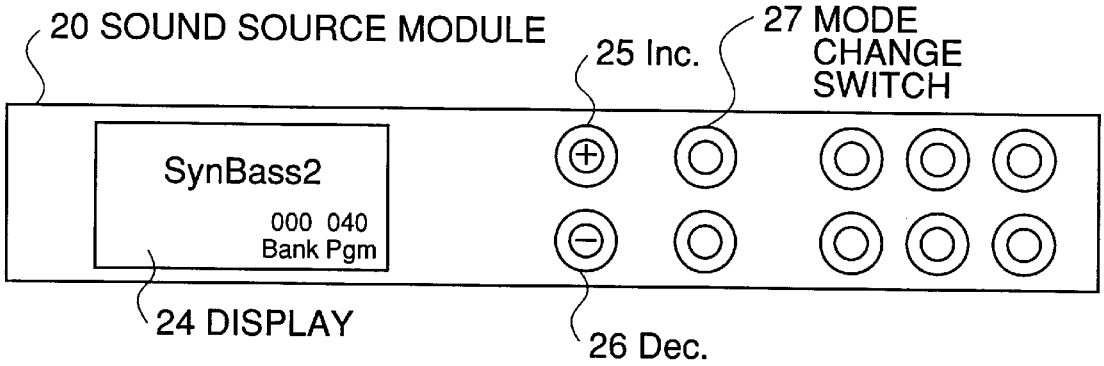
FIG. 2B is a view showing the construction of a front panel of the sound source module of FIG. 1.

FIG. 2A and 2B show an appearance of the sound source module 20 constructed as described above. More specifically, FIG. 2A shows a back panel of the module 20 on which are provided three MIDI terminals, namely, a MIDI IN terminal 21 through which MIDI data are entered, a MIDI OUT terminal 22 through which a MIDI signal is generated, and a MIDI THRU terminal 23 through which a MIDI signal entered through the MIDI IN terminal 21 is generated without being processed. Although other terminals that output generated musical tones, and so forth, are also provided on the back panel, these terminals are not illustrated in FIG. 2A.

FIG. 2B shows a front panel of the sound module 20 of the present embodiment, on which are provided at least a display 24 that displays various information, an increment switch (Inc.) 25 and a decrement switch (Dec.) 26 used for setting the bank number, a program change number and others when selecting a tone color, and a mode change switch 27 that is operated to change a tone color selection mode when selecting the tone color.

The front panel of the sound module 20 is also provided with mode setting switches used for setting modes, such as tone color selection mode, part setting mode, and musical tone parameter setting mode.

In the example shown in FIG. 2B, "SynBass" that is a name of a tone color is displayed on the display 24 that corresponds to the display block 11 in FIG. 1, and a bank number "000" and a program change number "040" of this tone color on the tone color list are also displayed.

Figure 3:
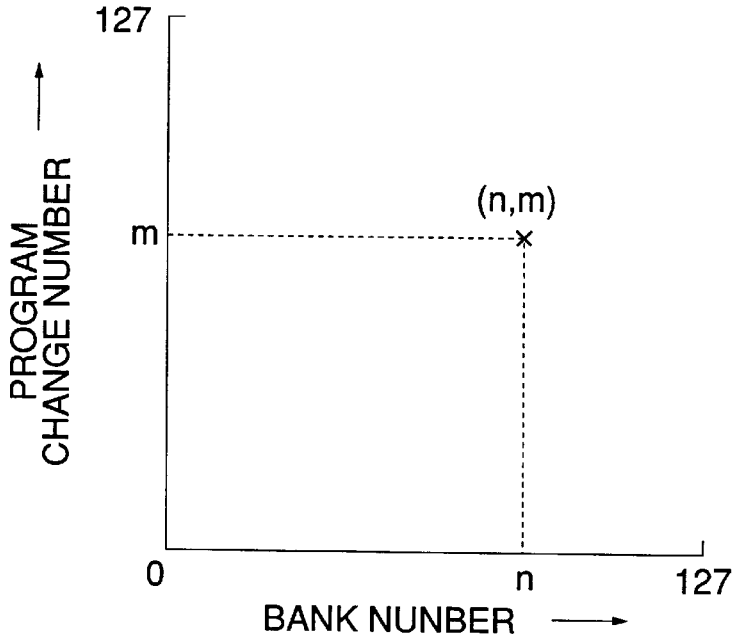
FIG. 3 is a view useful in explaining a method of selecting a desired tone color from a tone color list.

In this sound source module 20, the tone color of a musical tone to be generated by the module 20 is set by a combination of a bank number and a program change number, where the bank number is taken along the abscissa, and the program change number is taken along the ordinate, as shown in FIG. 3. In this embodiment, the sound source module uses a tone color list or table that has 128 locations in rows to which the bank numbers "0" through "127" are respectively assigned, and 128 locations in columns to which the program change numbers "0" through "127" are respectively assigned. A particular tone color at the address (n, m) may be selected by setting the bank number to "n", and setting the program change number to "m", as shown in FIG. 3.

One example of the tone color list is shown in FIGS. 4, 5 and 6. It is to be noted that only two musical instrument groups of basic tones, namely, those of Piano and Bass, are shown in FIGS. 4–6, and other fourteen musical instrument groups are omitted from the list. While this tone color list contains 128 banks as numbered from "0" to "127", banks following bank number "65" are omitted in FIG. 6. The musical instrument groups omitted from the list may include Organ, Guitar, Strings, Brass and others.

In this tone color list, eight program change numbers are assigned to each musical instrument group, and eight basic tone colors are stored in each musical instrument group. These basic tone colors are stored in the column of bank number "0", and the total number of basic tone colors stored in the bank number "0" is 128, namely 128 kinds of basic tone colors are stored in the tone color list.

Each bank having the bank number "1" to "127" may store an extended tone color that is a variation of a corresponding basic color stored in the bank number "0". The extended tone colors, however, are not necessarily stored in all of the banks having the bank numbers "1" through "127". When the user selects a certain bank in which no extended tone color is named, musical tones having a corresponding basic tone color are generated.

When the sound source module 20 having the above-described tone color list is used to generate musical tones, the user operates the increment switch 25 and the decrement switch 26 to set the bank number and program change number, so as to generate musical tones having a desired tone color. According to the present invention, the tone color may be set in a selected one of first mode and second mode as tone color setting modes.

If the sound source module 20 is placed in the first mode by operating the mode change switch 27, the bank number is increased only by 1 to be changed to the next bank number when the increment switch 25 is operated upon setting of the bank number, and the bank number is decreased only by 1 to be changed to the previous bank number when the decrement switch 26 is operated.

One example of the operation in the first mode will be described with respect to the tone color "SynBass2" stored at the address of bank number "0" and program change number "40" (which will be referred to as "address (0, 40)"). If the increment switch 25 is operated by the user while the tone color stored at the address (0, 40) is selected, this address is changed to address (1, 40) where the basic tone color "Synbass2" is selected. If the increment switch 25 is operated again, the current address is changed to address (2, 40) where the basic tone color "Synbass2" is selected. If the increment switch 25 is then serially operated, the current address is serially changed to address (3, 40) where the basic tone color "SynBass2" is selected, address (4, 40) where the basic tone color "SynBass2" is selected, address (5, 40) where the basic tone color "SynBass2" is selected, and then to address (6, 40) where an extended tone color "MelloSB1" is selected. Thus, the increment switch 25 is operated six times so that the first extended tone color "MelloSB1" is selected. If the increment switch 25 is operated additional six times, the second extended tone color "Seq Bass" stored at address (12, 40) (that is 6 banks ahead of the current address (6, 40)) can be selected.

If the mode change switch 27 is operated to establish the second mode as the tone color selection mode, the bank number may be set to a number of the next or previous bank in which a tone color different from the current tone color is present, each time the increment switch 25 or decrement switch 26 is operated. Thus, setting of the tone color can be accomplished in this second mode with improved efficiency.

Referring to FIG. 4, an example of the operation in the second mode will be described in which the tone color "SynBass2" stored at the address of bank number "0" and program change number "40" (which will be referred to as "address (0, 40)") is currently selected. If the increment switch 25 is operated by the user in this state, the bank number is changed to "6", and the extended tone color "MelloSB1" stored at (the corresponding) address (6, 40) is selected (designated). If the increment switch 25 is operated again, the bank number is changed to "12", and the extended tone color "Seq Bass" stored at address (12, 40) is selected. If the increment switch 25 is operated once again, the bank number is changed to "18", and an extended tone color "ClkSynBa" stored at address (18, 40) is selected. If the increment switch 25 is operated once again, the bank number is changed to "19", and an extended tone color "SynBa2DK" stored at (the corresponding) address (19, 40) is selected.

Referring to the tone list shown in FIG. 4 through FIG. 6, another example of the operation in the second mode will be described in which the decrement switch 26 is operated while a tone color defined by bank number "65" of Piano group and program change number "8" is currently selected, namely, an extended tone color "Pierce1" stored at address (65, 8) is currently selected. If the decrement switch 26 is operated in this state, an extended tone color "PulseClv" stored at address "64, 8" is selected. If the decrement switch 26 is operated again, the bank number jumps to "27", and an extended tone color "ClaviWah" stored at address (27, 8) is selected. If the decrement switch 25 is operated once again, the bank number jumps to "1", and an extended tone color "Clavi.K" is selected. If the decrement switch 26 is operated again, the bank number is changed to "0", and the basic tone color "Clavi." stored at address (0, 8) is selected.

Thus, when the tone color selection mode is set to the second mode, the bank number can be changed more efficiently by operating the switches a reduced number of times, so as to set the tone color to a desired one.

Also, when the selected tone color is changed to a different one, the name of the newly selected tone color and its bank number and program change number are displayed on the display 24 (11).

Furthermore, a numeric keypad may be provided so that the program change number is set in a mode for setting the program change number, and the part number is set in a mode for setting the part number.

The musical tone generating apparatus of the present invention may be provided with a communication interface connected to telecommunication networks, such as LAN (Local Area Network), Internet, and telephone line, and thus the musical tone generating apparatus and external apparatus may be connected to each other by communication means including various types of networks.

The tone generator block 12 may produce musical tones by any tone generating method, such as a waveform memory method, an FM method, a physical model method, a higher harmonic synthesis method, a formant synthesis method, and a method of an analog synthesizer having VCO (Voltage Controlled Oscillator), VCF (Voltage Controlled Filter), and VCA (Voltage Controlled Amplifier). In this connection, the tone generator block 12 is not limited to that constituted by a hardware exclusively used as a tone generator, but may be constituted by a tone generator program or programs executed by a digital signal processor (DSP) or CPU.

The object of the present invention may also be accomplished by supplying a system or an apparatus with a storage medium in which a software program having the function of the above- described embodiment is recorded, and causing a computer (CPU 1 or MPU) of the system or apparatus to read out and execute the program stored in the storage medium.

In this case, the program itself read out from the storage medium accomplishes the novel function of the present invention, and the storage medium storing the program thus constitutes the present invention.

The storage medium for supplying the above program to the system or apparatus may be in the form of a hard disc, CD-ROM, MO, MD, floppy disc, CD-R (CD-Recordable), magnetic tape, nonvolatile memory card, or ROM, for example. Also, the program may be supplied from other MIDI equipment or a server computer through a suitable telecommunication network.

The function of the illustrated embodiment may be accomplished not only by executing the program read by the computer, but also by causing OS operating on the computer to perform a part or all of actual operations according to instructions of the program.

Further, the program read out from the storage medium may be written into a memory provided in an expanded board inserted in the computer or an expanded unit connected to the computer, and CPU 1 or the like provided in the expanded board or expanded unit may actually perform part of or all of the operations according to the instructions of the program, so as to accomplish the function of the illustrated embodiment.

What is claimed is:

1. A musical tone generating apparatus that generates a musical tone of a selected one of tone colors that is defined by a combination of a first kind of number and a second kind of number, comprising:

an operating element used for setting a tone color and having an incrementing function and a decrementing function, said operating element being operated to set at least said second kind of number by using at least one of the incrementing function and decrementing function; and a memory device that stores a list in which the tone colors to be selected are listed, said list having a first axis having a plurality of locations to which a plurality of first kind of numbers are respectively assigned, and a second axis having a plurality of locations to which a plurality of second kind of numbers are respectively assigned, each of said first kind of numbers having a basic tone color assigned thereto, each of said second kind of numbers having an extended tone color that is a variation of the basic tone color of a corresponding one of said first kind of numbers;

wherein each time said operating element is operated, one of the second kind of numbers that is assigned to a currently selected tone color is changed to a number of the second kind assigned to a tone color that is different from the currently selected tone color and is present next to the currently selected tone color in said list.

2. A musical tone generating apparatus that generates a musical tone of a selected one of tone colors that is defined by a combination of a first kind of number and a second kind of number, comprising:

an operating element used for setting a tone color and having an incrementing function and a decrementing function, said operating element being operated to set at least said second kind of number by using at least one of the incrementing function and the decrementing function; and a memory device that stores a list in which the tone colors to be selected are listed, said list having a first axis having a plurality of locations to which a plurality of first kind of numbers are respectively assigned, and a second axis having a plurality of locations to which a plurality of second kind of numbers are respectively assigned, each of said first kind of numbers having a basic tone color assigned thereto, each of said second kind of numbers having an extended tone color that is a variation of the basic tone color of a corresponding one of said first kind of numbers; and a switch device capable of switching between a first mode in which each time said operation part is operated, one of the second kind of numbers assigned to a currently selected tone color is changed to a number of the second kind that is different by one from said one of the second kind of numbers, and a second mode in which each time said operating element is operated, one of the second kind of numbers assigned to a currently selected tone color is changed to a number of the second kind assigned to a tone color that is different from the currently selected tone color and is present next to the currently selected tone color in said list.

3. A musical tone generating apparatus according to claim 2, further comprising:

an input device through which a MIDI event is entered; and a musical tone signal producing device that produces a musical tone signal in accordance with said MIDI event entered through said input device;

wherein said first kind of number is determined by a program change number of said MIDI event, and said second kind of number is determined by a bank number of said MIDI event.

4. A musical tone generating apparatus according to claim 3, wherein said list contains basic tone colors that correspond one by one to all of said plurality of first kind of numbers, and expanded tone colors to which only a part of said plurality of second kind of numbers are assigned, and wherein when the second kind of number is set to a number of the second kind having no expanded tone color assigned thereto, a corresponding one of the basic tone colors is selected.

5. A musical tone generating apparatus according to claim 4, wherein said basic tone colors comprise tone colors of normal musical instruments.

6. A musical tone generating method for generating a musical tone of a selected one of tone colors that is defined by a combination of a first kind of number and a second kind of number, comprising the steps of:

setting at least said second kind of number by operating an operating element used for setting a tone color and having an incrementing function and a decrementing function; and storing in a memory device a list in which the tone colors to be selected are listed, said list having a first axis having a plurality of locations to which a plurality of first kind of numbers are respectively assigned, and a second axis having a plurality of locations to which a plurality of second kind of numbers are respectively assigned, each of said first kind of numbers having a basic tone color assigned thereto, each of said second kind of numbers having an extended tone color that is a variation of the basic tone color of a corresponding one of said first kind of numbers;

wherein each time said operating element is operated, one of the second kind of numbers that is assigned to a currently selected tone color is changed to a number of the second kind assigned to a tone color that is different from the currently selected tone color and is present next to the currently selected tone color in said list.

7. A musical tone generating method for generating a musical tone of a selected one of tone colors that is defined by a combination of a first kind of number and a second kind of number, comprising the steps of:

setting at least said second kind of number by operating an operating element used for setting a tone color and having an incrementing function and a decrementing function; and storing in a memory device a list in which the tone colors to be selected are listed, said list having a first axis having a plurality of locations to which a plurality of first kind of numbers are respectively assigned, and a second axis having a plurality of locations to which a plurality of second type of numbers are respectively assigned, each of said first kind of numbers having a basic tone color assigned thereto, each of said second kind of numbers having an extended tone color that is a variation of the basic tone color of a corresponding one of said first kind of numbers; and switching a mode for setting said second kind of number between a first mode in which each time said operation part is operated, one of the second kind of numbers assigned to a currently selected tone color is changed to a number of the second kind that is different by one from said one of the second kind of numbers, and a second mode in which each time said operating element is operated, one of the second kind of numbers assigned to a currently selected tone color is changed to a number of the second kind assigned to a tone color that is different from the currently selected tone color and is present next to the currently selected tone color in said list.

8. A musical tone generating method according to claim 7, further comprising the steps of:

entering a MIDI event through an input device; and producing a musical tone signal in accordance with said MIDI event entered through said input device;

wherein said first kind of number is determined by a program change number of said MIDI event, and said second kind of number is determined by a bank number of said MIDI event.

9. A musical tone generating method according to claim 8, wherein said list contains basic tone colors that correspond one by one to all of said plurality of first kind of numbers, and expanded tone colors to which only a part of said plurality of second kind of numbers are assigned, and wherein when said second kind of number is set to a number of the second kind having no expanded tone color assigned thereto, a corresponding one of the basic tone colors is selected.

10. A musical tone generating method according to claim 9, wherein said basic tone colors comprise tone colors of normal musical instruments.

11. A storage medium storing commands that are readable by a machine, to execute a musical tone generating method for generating a musical tone of a selected one of tone colors that is defined by a combination of a first kind of number and a second kind of number, said musical tone generating method comprising the steps of:

setting at least said second kind of number by operating an operating element used for setting a tone color and having an incrementing function and a decrementing function; and storing in a memory device a list in which the tone colors to be selected are listed, said list having a first axis having a plurality of locations to which a plurality of first kind of numbers are respectively assigned, and a second axis having a plurality of locations to which a plurality of second kind of numbers are respectively assigned, each of said first kind of numbers having a basic tone color assigned thereto, each of said second kind of numbers having an extended tone color that is a variation of the basic tone color of a corresponding one of said first kind of numbers;

wherein each time said operating element is operated, one of the second kind of numbers that is assigned to a currently selected tone color is changed to a number of the second kind assigned to a tone color that is different from the currently selected tone color and is present next to the currently selected tone color in said list.

12. A storage medium storing commands that are readable by a machine, to execute a musical tone generating method for generating a musical tone of a selected one of tone colors that is defined by a combination of a first kind of number and a second kind of number, said musical tone generating method comprising the steps of:

setting at least said second kind of number by operating an operating element used for setting a tone color and having an incrementing function and a decrementing function; and storing in a memory device a list in which the tone colors to be selected are listed, said list having a first axis having a plurality of locations to which a plurality of first kind of numbers are respectively assigned, and a second axis having a plurality of locations to which a plurality of second kind of numbers are respectively assigned, each of said first kind of numbers having a basic tone color assigned thereto, each of said second kind of numbers having an extended tone color that is a variation of the basic tone color of a corresponding one of said first kind of numbers; and switching a mode for setting said second kind of number between a first mode in which each time said operation part is operated, one of the second kind of numbers assigned to a currently selected tone color is changed to a number of the second kind that is different by one from said one of the second kind of numbers, and a second mode in which each time said operating element is operated, one of the second kind of numbers assigned to a currently selected tone color is changed to a number of the second kind assigned to a tone color that is different from the currently selected tone color and is present next to the currently selected tone color in said list.

* * * * *